US005380967A

United States Patent [19]

Steen et al.

[11] Patent Number: 5,380,967

[45] Date of Patent: Jan. 10, 1995

[54] EXTENSION ACTUATOR FOR ELECTRICAL WALL SWITCH

[76] Inventors: Carson D. Steen; Robby W. Steen, both of 402 Tillman Rd., Fort Mill, S.C. 29715

[21] Appl. No.: 192,553

[22] Filed: Feb. 7, 1994

[51] Int. Cl.[6] ..... H01H 3/20

[52] U.S. Cl. ..... 200/331; 200/330; 200/329

[58] Field of Search ..... 200/331, 332, 330, 329

[56] References Cited

U.S. PATENT DOCUMENTS

| | | | |
|---|---|---|---|
| 2,389,220 | 11/1945 | Tredeau | 200/331 |
| 2,668,456 | 2/1954 | Meistrell | 200/331 |
| 3,077,789 | 2/1963 | Lashmutt | 200/331 |
| 3,581,037 | 5/1971 | Schiffelbein | 200/331 |
| 3,825,710 | 7/1974 | Roberts et al. | 200/331 |
| 3,839,615 | 10/1974 | Bradford | 200/331 |
| 4,256,943 | 3/1981 | Whitlock | 200/331 |
| 4,295,026 | 10/1981 | Williams et al. | 200/331 |
| 4,419,556 | 12/1983 | Hare | 200/331 |
| 4,454,401 | 6/1984 | Powis, Jr. | 200/331 |
| 4,567,337 | 1/1986 | Woods et al. | 200/331 |
| 4,705,924 | 11/1987 | Hevoyan | 200/331 |
| 4,870,232 | 9/1989 | Hoogland | 200/331 |

FOREIGN PATENT DOCUMENTS

| | | | |
|---|---|---|---|
| 1242236 | 9/1988 | Canada | 200/331 |

*Primary Examiner*—Henry J. Recla
*Assistant Examiner*—David J. Walczak
*Attorney, Agent, or Firm*—Shefte, Pinckney & Sawyer

[57] ABSTRACT

A device for actuating conventional toggle-type and rocker-type electrical wall switches such as light switches, particularly adapted for facilitating switch operation by children and handicapped persons who cannot reach the normal elevation at which such switches are installed, utilizes an elongated operating arm with a portion at one end for operating engagement with the switch, e.g., an opening to receive a toggle switch or a protuberance to rest in contact against a rocker switch, and a pin projecting outwardly from the other end, the arm depending downwardly from the switch flatly against the wall and constrained to longitudinal reciprocating operational movement by a pair of guiding members each affixed directly to the wall or to the wall and the switch and defining respective aligned recesses facing the wall within which the arm slides, the lowermost guiding member having an elongated slot through which the arm's pin extends outwardly for manual actuation of upward and downward sliding movement of the arm to move the switch between its on and off positions.

2 Claims, 5 Drawing Sheets

EXTENSION ACTUATOR FOR ELECTRICAL WALL SWITCH

BACKGROUND OF THE INVENTION

The present invention relates generally to devices for actuating switches and, particularly, to devices for remote actuation of wall mounted electrical switches, e.g., toggle-type and rocker-type light switches and the like.

Toggle-type and rocker-type electrical on-off switches are commonly employed in homes and buildings for controlling actuation of lights and other electrical appliances. Typically, such switches are mounted to a vertical wall at a relatively standard height of about 4 feet above the floor to be conveniently accessible to most people and to present minimal risk of obstruction by furniture. However, at such height, it is difficult, if not impossible, for small children or handicapped persons to reach and operate such wall switches. A number of devices and apparatus have been proposed in the past to address this problem, the devices typically employing some form of extension rod or arm attached to and extending downwardly from the wall switch to a lower level at which a child or handicapped person can actuate the switch remotely using the extension rod or arm. Representative examples of these types of devices are disclosed in U.S. Pat. Nos. 2,389,220; 2,493,581; 2,668,456; 3,077,789; 3,581,037; 3,825,710; 3,839,615; 4,256,943; 4,454,401; 4,567,337; 4,419,556; 4,705,924; 4,870,232. Disadvantageously, many of such devices are unnecessarily complicated in construction and difficult to install, including in some cases the undesirable necessity that the switch be partially disassembled (e.g., removal of the switch-covering plate) to accomplish installation.

SUMMARY OF THE INVENTION

It is accordingly an object of the present invention to provide an improved actuator for wall-mounted switches, particularly toggle-type and rocker-type switches, which is of a simplified construction and is quick and easy to install, without any necessity to remove the switch-covering plate or otherwise access the interior of the switch.

Briefly summarized, the switch-actuating device of the present invention basically comprises an elongate operating arm having a portion at one end of the arm configured for engaging the movable switch member of the wall switch, e.g., a toggle member or rocker member, and an actuating pin extending outwardly from the opposite end of the arm for manually actuating longitudinal movement of the arm. In embodiments for use with toggle-type switches, the switch engaging portion of the arm is formed with an opening for extension therethrough of the toggle member of the switch. In embodiments for use with rocker-type switches, the switch engaging portion of the arm is formed with a protuberance which projects into engagement with the rocker member of the switch.

At least one arm guiding member is mountable to the wall for constraining the arm to move longitudinally when actuated by the pin, the guiding member having a pair of mounting surfaces spaced laterally from one another at opposite sides of a longitudinal arm-receiving recess. In embodiments for use with toggle-type switches, it is preferred to use a second wall-mountable arm guiding member at a spacing from the first-mentioned guiding member. In rocker-switch embodiments, a second arm guiding member is preferably mounted to the switch-covering plate directly beneath the movable rocker member. When so mounted, the recesses of the guiding members are aligned with one another to define, in conjunction with the wall and the switch plate as applicable, a pathway in which the arm is received for reciprocating longitudinal movement. Preferably, each guiding member includes an adhesive material on each of its mounting surfaces for affixation to the wall or switch plate.

The lowermost one of the guiding members has an elongate slot formed therethrough in alignment with its arm-receiving recess for extension of the actuating pin through the slot to be accessible for sufficient movement within the slot to actuate reciprocating longitudinal movement of the arm between opposed limit positions wherein the toggle, rocker, or other switch member of the switch is pivoted between its alternate operating positions.

In certain embodiments, e.g., the toggle-type switch embodiment, the arm may include a biasing portion for urging the one end of the arm into engagement with the switch member. The surface of either or both guiding members facing outwardly opposite from the wall-mounting surfaces enables a decoration or an informational notice to be carried on either or both arm guiding member.

DESCRIPTION OF THE PREFERRED EMBODIMENT

Figure 1:
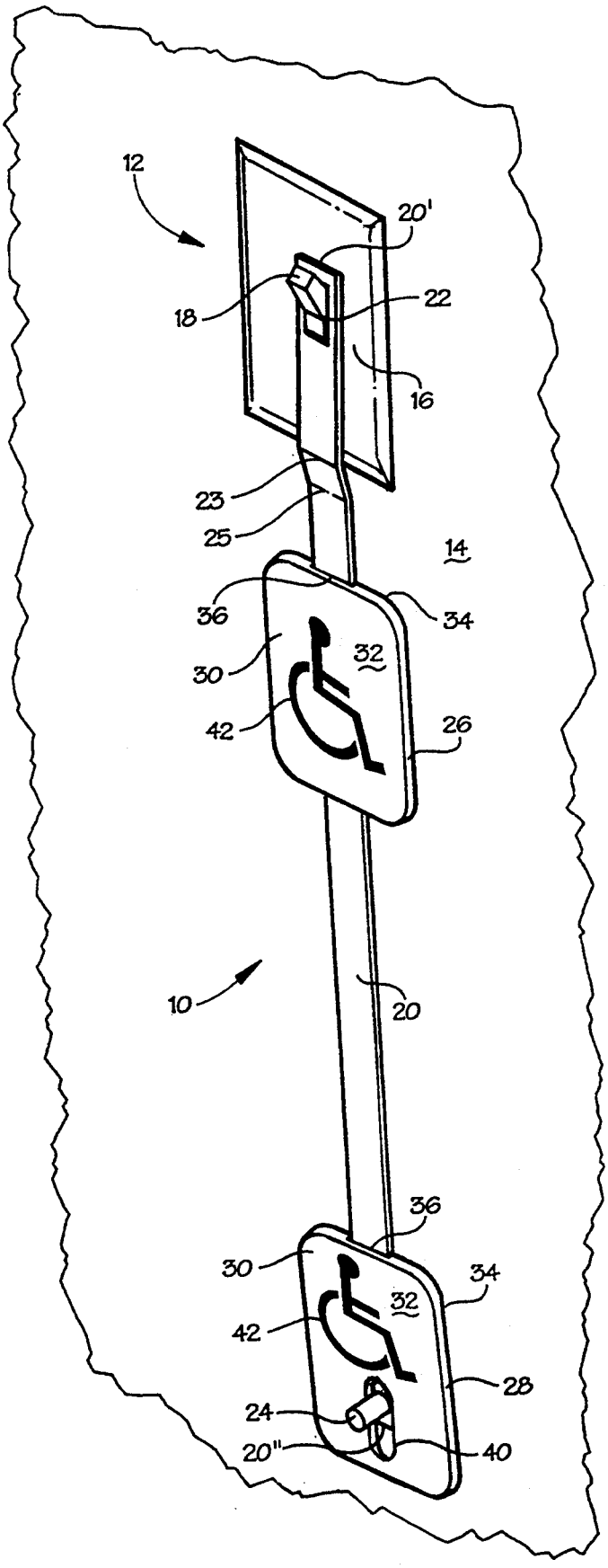
FIG. 1 is a perspective view of a toggle switch actuating device in accordance with one preferred embodiment of the present invention, shown installed and in operation.
Figure 2:
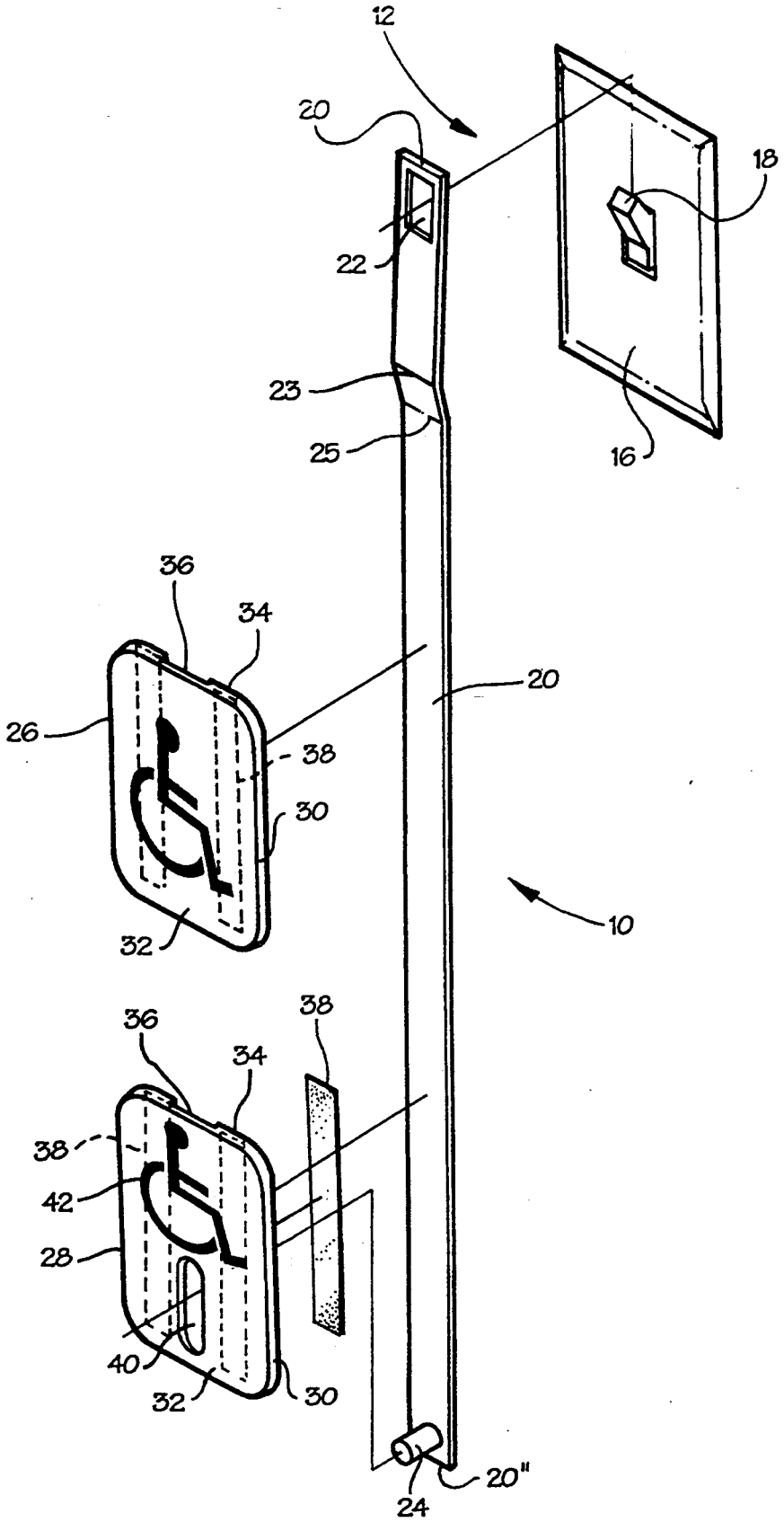
FIG. 2 is an exploded perspective view of the toggle switch actuating device of FIG. 1.
Figure 3:
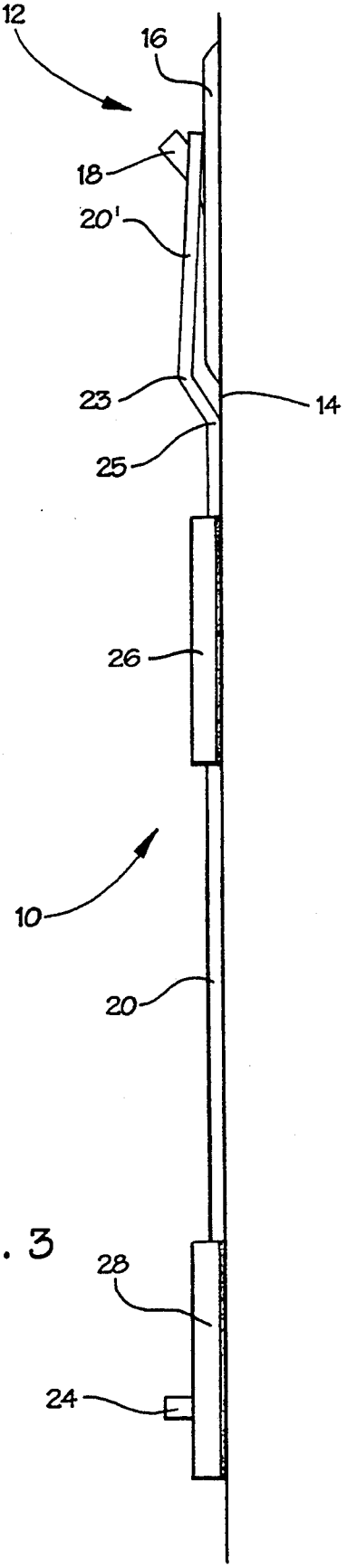
FIG. 3 is a side elevational view of the toggle switch actuating apparatus of FIG. 1.

Referring now to the accompanying drawings and initially to FIGS. 1–3, one preferred embodiment of the present switch actuating device is shown generally at 10 in FIG. 1 as installed on an electrical light switch 12 of the conventional toggle-type having a switch body (not shown) mounted within a building wall 14 and covered by a switch plate 16 through which a pivotable toggle member 18 extends outwardly for manual on-off control of the switch 12 by pivoting the toggle member 18 alternately between upward and downward limit positions.

The actuating device 10 includes an elongate operating arm 20 having a substantially square opening 22 formed in its upper end 20' and a cylindrical pin 24 projecting outwardly from the opposite lower end 20''. The opening 22 is configured and dimensioned to snugly receive the toggle member 18. In this manner, the operating arm 20 depends vertically downwardly from the toggle member 18 of the light switch 12, the arm 20 being of a sufficient predetermined length, e.g., approximately 18 to 20 inches in length, to position the pin 24 at an elevation above the adjacent floor (not shown) at which the pin 24 can be easily reached by handicapped persons and small children.

The operating arm 20 is of a substantially rectangular band or web-like configuration having a relatively thin cross-sectional thickness for placement substantially flatly against the wall 14, with slight bends 23,25 being formed at a spacing from the upper end 20' to enable the upper end portion of the arm 20 to overlie the switch plate 16 at a slight inward angle toward the wall 14 to bias and maintain the upper end 20' in contact with the switch plate 16 with the toggle member 18 extending through the opening 22 in the arm's upper end 20'.

A pair of arm guiding members 26,28 are mountable to the wall 14 to constrain the arm to longitudinal reciprocating movement upwardly and downwardly by corresponding manual upward and downward movement of the pin 24. For this purpose, each arm guiding member 26 is configured in the form of a substantially flat plate-like body 30 having a generally planar outer surface 32 and laterally-spaced co-planar inner surfaces 34 separated by a linear recess 36 dimensioned in depth and transverse width in correspondence to the arm 20. Each of the opposed inner surfaces 34 carries an adhesive material, preferably in the form of a double-sided adhesive tape 38, whereby the arm guiding members 26,28 may be readily adhered to the wall 14 in spaced relation to one another at appropriate locations below the light switch 12 with the respective recesses 36 of the guiding members aligned to receive the arm 20 for sliding reciprocation within the confinement of the recesses.

The lower arm guiding member 28 additionally includes an elongate slot 40 formed entirely through the body 30 in alignment with the recess 36 to receive the pin 24. The slot 40 is of a sufficient length for movement of the pin 24 vertically between upper and lower limit positions wherein the toggle member 18 of the light switch 12 is disposed under the longitudinal reciprocating influence of the arm 20 in the on and off upward and downward limit positions, respectively, of the switch 12.

Advantageously, the flat planar outer surface 32 of the arm guiding members 26,28 enables any desirable form of decal, sticker or the like to be affixed to one or both guiding members 26,28 for decorative or informational purposes, such as representatively indicated by the decal 42 displaying the standard international handicapped symbol. When the device 10 is used in a home, such as in a child's bedroom, any form of decorative decal or sticker, e.g., a clown's face, may be used instead.

Installation of the device 10 may be readily understood to be extremely simple and quick to accomplish. Specifically, the arm 20 is simply placed in depending manner on the toggle member 18 of a selected light switch 12 by situating the opening 22 over the toggle member 18. With the arm 20 hanging downwardly, the arm guiding members 26,28 are adhered to the wall over the arm 20 so that each recess 36 slidably receives the arm 20 and with the lower arm guiding member 28 receiving the pin 24 projecting outwardly through the slot 40. Preferably, the upper arm guiding member 26 is disposed at a short spacing immediately below the bends 23,25 in the arm 20 so that the guiding member 26 assists in constraining the upper end portion 20' of the arm 20 into overlying engagement with the switch plate 16.

The switch actuating device of the present invention offers a number of distinct advantages over known actuating devices. First, as will be understood from the above description, the device 10 is extremely simple and easy to install and particularly does not require removal or loosening of the switch plate 16 or any other disassembly or alteration of the light switch 12, but is simply placed over the projecting toggle member 18 of the light switch. The pin-and-slot connection between the lower end of the actuating arm 20 and the lower arm guiding member 28 substantially simulates the same on-off pivoting movement of the toggle member 18, so that the normal operation of the light switch 12 is essentially unchanged. Further, the arm guiding members 26,28 maintain the arm 20 substantially flatly against the wall 14, which prevents a child from being able to easily reach behind the actuator arm 20 to pull the arm away from the wall 14, thereby minimizing the risk of damage or breakage of the device 10.

Figure 4:
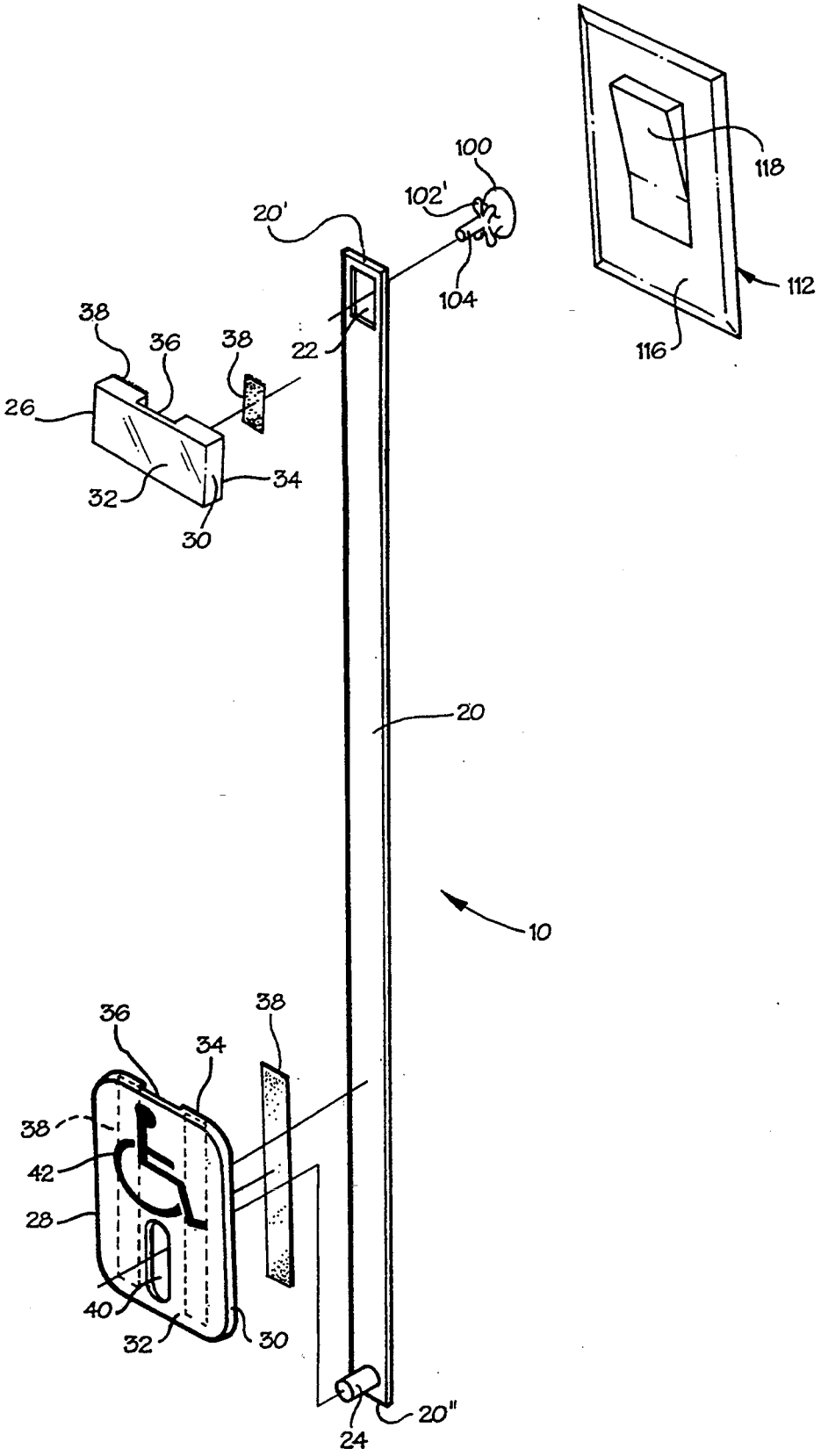
FIG. 4 is an exploded perspective view of a rocker switch actuating device in accordance with another preferred embodiment of the present invention.
Figure 5:
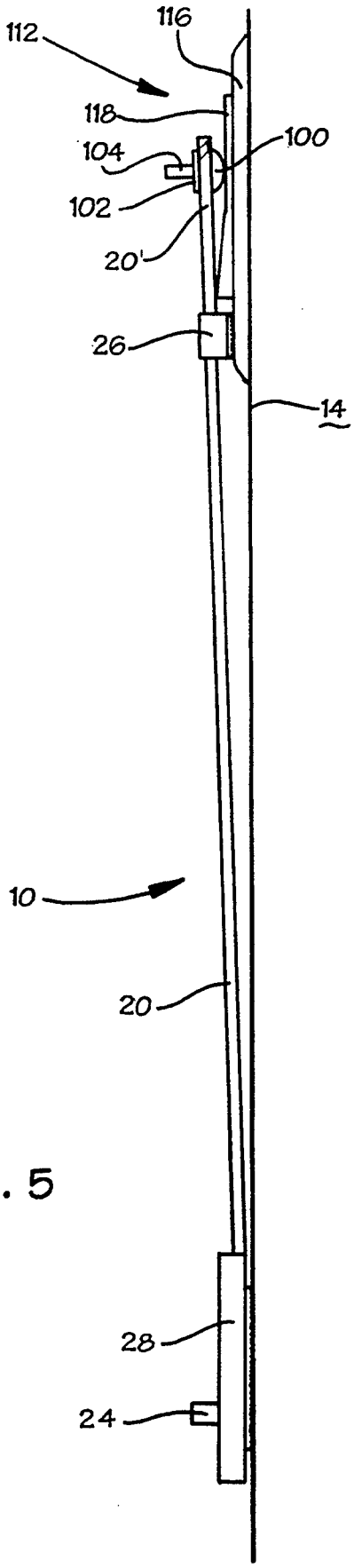
FIG. 5 is a side elevational view of the rocker switch actuating apparatus of FIG. 4.

Referring now to FIGS. 4 and 5, an alternative embodiment of the switch actuating device 10 is shown for use in operating a conventional rocker-type electrical light switch 112. The rocker-type switch 112 has a switch body (not shown) mounted within a building wall 14 and covered by a switch plate 116 through which a pivotable rocker member 118 is exposed outwardly for manual on/off control of the switch 112 by manual pressing of the upper and lower angularly-related surfaces of the rocker member 118 to pivot it between opposing on and off limit positions. In this embodiment, the actuating device 10 is substantially the same as that of FIGS. 1–3 except that (a) the actuating arm 20 is substantially linear, without any biasing bends 23,25; (b) an actuating protuberance in the form of a rounded button 100 is snap-fit by a resilient base portion 102 thereof through the opening 22 in the actuating arm 20 so that the main rounded body of the button 100 protrudes outwardly from the wall-facing side of the arm 20 for operating contact with the rocker member 118; and (c) the upper arm guiding member 26 is configured of a reduced dimension for adhesion directly to the switch covering plate 116, rather than to the wall 14, immediately beneath the rocker member 118. Installation and operation of the actuating body 10 in this embodiment is therefore otherwise the same as in the previously-described embodiment of FIGS. 1–3. Specifically, upon manual movement of the pin 24 upwardly and downwardly within the slot 40 in the lower arm guiding member 28, the corresponding upward and downward movement of the arm 20 causes the button 100 to move between upper and lower positions in which the button 100 acts to depress respectively the upper and lower angled surfaces of the rocker member 118, thereby to pivot the rocker member 118 between its on and off limit positions. An extension pin 104 on the protuberance projects outwardly through the opening 22 in the actuating arm to allow operation of the switch to be controlled directly at the switch location generally in the fashion of a toggle-type switch. All of the same advantages of simple installation and operation which are achieved by the first-described embodiment of FIGS. 1–3 are equally achieved in this embodiment.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. In combination, a toggle switch mounted to a wall, the toggle switch having a switch covering plate outwardly abutting the wall and a toggle member extending outwardly from the wall through the switch covering plate for pivoting movement between alternate operating positions, and a device for remote actuation of the toggle member, the device comprising an elongate operating arm of a substantially flat planar configuration disposed in essentially continuous slidable outward surface abutment with the wall and the switch covering plate, one end of the arm being connected to the toggle switch only by an opening in the one end of the arm through which the toggle member extends, the opposite end of the arm having an actuating pin affixed rigidly thereto and extending outwardly from the arm away from the wall for manually actuating longitudinal movement of the arm to cause pivoting movement of the toggle member, and a pair of arm guiding plates affixed only adhesively to the wall at spacing from one another for constraining the arm to slide longitudinally along the wall when actuated by the pin, each guiding plate having a substantially flat planar body having a wall-facing side formed of a pair of flat wall-mounting adhesive surfaces adhered to the wall at lateral spacings from one another at opposite sides of a longitudinal recess spaced from the wall, the arm extending through the recess in each guiding plate, the recess of each guiding plate being configured in close conformity to the flat planar configuration of the arm for defining in conjunction with the wall a pathway in which the arm is constrained for reciprocating longitudinal movement in sliding surface abutment with the wall and the switch covering plate, one of the guiding plates having an elongate slot formed therethrough in alignment with its arm-receiving recess with the actuating pin of the arm extending outwardly through the slot to be accessible for sufficient movement within the slot to actuate reciprocating longitudinal movement of the arm between opposed limit positions wherein the toggle member is pivoted between its alternate operating positions, whereby installation of the device may be accomplished without tools by placing the arm by its opening onto the toggle member and then adhering the guiding plates to the wall over the arm.

2. The combination of claim 1, wherein the arm includes a biasing portion for urging the arm into engagement with the toggle member.

* * * * *

UNITED STATES PATENT AND TRADEMARK OFFICE

CERTIFICATE OF CORRECTION

PATENT NO. : 5,380,967

DATED : January 10, 1995

INVENTOR(S) : Carson D. Steen and Robby W. Steen

It is certified that error appears in the above-identified patent and that said Letters Patent is hereby corrected as shown below:

Column 6, line 3, after "at" insert -- a --.

Signed and Sealed this

Seventeenth Day of October, 1995

*Attest:*

Bruce Lehman

BRUCE LEHMAN

*Attesting Officer*

*Commissioner of Patents and Trademarks*